US006131228A

United States Patent [19]

Chen et al.

[11] Patent Number: 6,131,228

[45] Date of Patent: Oct. 17, 2000

[54] BRUSH FOR CLEANING THE TONGUE ROOT

[76] Inventors: Joseph Chen, 119 Arlozorov Street, Tel Aviv 62098; Jacob Chen, 7 Boker Street, Herzlia 46474, both of Israel

[21] Appl. No.: 09/154,886

[22] Filed: Sep. 17, 1998

[51] Int. Cl.[7] ..... A46B 17/24

[52] U.S. Cl. ..... 15/22.1; 15/160; 15/210.1; 606/161

[58] Field of Search ..... 15/160, 167.1, 15/210.1, 22.1; 606/161

[56] References Cited

U.S. PATENT DOCUMENTS

| | | | |
|---|---|---|---|
| D. 388,616 | 1/1998 | Wieder et al. | D4/111 |
| D. 400,357 | 11/1998 | Crosson | D4/111 |
| 2,708,762 | 5/1955 | Kling et al. . | |
| 3,943,592 | 3/1976 | Bhaskar et al. . | |
| 4,079,478 | 3/1978 | Andrews, Sr. | 15/210 R |
| 4,288,883 | 9/1981 | Dolinsky | 15/110 |
| 4,638,521 | 1/1987 | Potente et al. | 15/111 |
| 5,005,246 | 4/1991 | Yen-Hui . | |
| 5,005,247 | 4/1991 | Hsieh . | |
| 5,226,197 | 7/1993 | Nack et al. . | |
| 5,718,667 | 2/1998 | Sugimoto et al. | 601/139 |
| 5,842,247 | 12/1998 | Decesare | 15/106 |

OTHER PUBLICATIONS

Rosenberg, Mel, PH.D., "Clinical Assessment of Bad Breath: Current Concepts," *JADA,* vol. 127, Apr. 1996, pp. 475–482.

Rosenberg et al., "BDA Fact File," British Dental Association, Jul. 1996.

"Anareobic Microflora of the Tongue Cause Oral Malodor (English translation)", *Update OdontologyUpdate Odontology,* Section 27, Issue 25, in cooperation with the International Israeli Society JADR, Sep.–Oct., 1996.

Internet advertisement for *Dr. Wieder's Original Tung Brush,* http://jamin.com/tungbrush/. Month, year unknown.

Photograph of the human tongue, illustrating various components in top and sectional views. Month, year unknown.

*Primary Examiner*—Robert J. Warden, Sr.
*Assistant Examiner*—Kaj K. Olsen
*Attorney, Agent, or Firm*—Barry R. Lipsitz

[57] ABSTRACT

A device and method for mechanically cleaning the surface of the root of the human tongue, the device including a cleaning head configured for entry between the soft palate and the surface of the human tongue root, and having abrasive means for mechanically removing pathological microorganisms from the surface of the tongue root, and a handle connected to the cleaning head for manipulation thereof, wherein the device has an overall maximum height at the cleaning head of no more than approximately 15 mm, and wherein the cleaning head is concavely bent. The method includes closing the lips to the rest position about the handle, so as to reduce the gag reflex and to position the handle and the cleaning head generally parallel to the tongue, and providing a relative motion between the cleaning head and the surface of the tongue root by reciprocally pivoting the cleaning head.

13 Claims, 4 Drawing Sheets

BRUSH FOR CLEANING THE TONGUE ROOT

FIELD OF THE INVENTION

The present invention relates to oral hygiene, in general, and to the reduction of pathological microorganisms in the oral cavity, in particular.

BACKGROUND OF THE INVENTION

The human tongue is located in the oral cavity, wherein various pathological microorganisms are also found. In addition, mouth saliva contains various defensive elements against foreign intruders. Ideally, the various microorganisms that inhabit the oral cavity are in mutual balance and symbiosis.

The surface of the tongue is not flat and has various protrusions and depressions, such as the areas of the foliate papilla, the circumvallate papilla, the fungiform papilla, and the filiform papilla. In some pathological situations, different infectious elements can penetrate these depressions, causing halitosis (offensive breath) as well as being a potential for the development of disease.

In addition to the topology of the tongue, with its various papillary elements, a further factor to be considered is the proximity and connection of the tongue to the nose, sinuses, tonsils, and uvula and throat area. This renders the tongue particularly susceptible to invasion of different microorganisms, including pathological microorganisms, in a situation of locus minoris resistenta.

Among groups of people who may be particularly susceptible to the development of pathological conditions, due to an imbalance between the various microorganisms in the oral cavity, are denture wearers, people taking antibiotics over a prolonged period of time, people with recurring chronic gum disease, people with tooth implants, and heavy smokers.

It has been found that most of the pathological microorganisms in the oral cavity are located on the root of the tongue, and that, notwithstanding the fact that various mouthwashes for reducing halitosis are available in the market, they do not provide an effective solution to this problem.

In the April 1964 edition of "THE DENTAL PRACTITIONER", it is suggested on page 313 that halitosis can be reduced by scraping the tongue. More recently, on Feb. 18, 1994, during a lecture to dental surgeons at the University of Tel Aviv, Professor Rosenberg suggested that, in order to clean the root of the tongue so as to eliminate, or at least substantially reduce, halitosis, it is desirable to brush the tongue root.

Toothbrushes are too large (high) to fit comfortably in the space between the soft palate and the tongue root, and they cannot therefore be used for brushing of the tongue root. Furthermore, any substantial reduction in the height of a toothbrush to a height which would enable it to be inserted comfortably between the soft palate and the tongue root would render it unsuitable for toothbrushing, and would therefor be undesirable.

Furthermore, conventional toothbrushes have elongated, relatively narrow heads which are substantially narrower than the tongue, their width being substantially the height of the teeth, and they are intended for a back-and-forth motion, along the longitudinal axis of the brush head. Accordingly, even if their height were such that they could be comfortably inserted between the tongue and the soft palate, a relatively large number of strokes would be required in order to cover the entire width of the tongue root, so this would not be an efficient manner of brushing the tongue root. Furthermore, this may lead to excessive irritation of the tongue root.

The described back-and-forth motion has a further disadvantage, in that it would result in repeated striking of the rear of the oral cavity, particularly the soft palate and the uvula, thereby causing discomfort and possibly leading to vomiting.

Use of a toothbrush for brushing of the tongue in a direction transverse to the longitudinal axis of the brush head would require the brush to be firmly held perpendicular to the tongue surface in a position which, when taking into account the brushing direction, is inherently unstable. Holding the brush in this position would thus be tiring, leading to inefficient brushing.

A number of patents deal with oral instruments for cleaning the tongue. U.S. Pat. No. 2,708,762 discloses an oral instrument including a toothbrush at one end, a pad including rubber massaging fingers at the other end thereof, and a tapered scraper blade in between.

U.S. Pat. No. 5,005,246 discloses a toothbrush having an integrally formed brush head with removable bristles for replacing the brush, and an elongate tongue scaler, including a tenon at one end, telescopically mounted in the brush handle.

U.S. Pat. No. 5,226,197 discloses a device for cleaning the tongue including a plurality of bristles and a semi-rigid scraper for removing debris from the tongue. The device is used in the same manner as a conventional toothbrush, and is moved anteriorly and posteriorly to scrape the tongue. (See col. 4, lines 35–50).

While these devices include means for cleaning the front of the tongue, they are incapable of cleaning the rear of the tongue without hitting the uvula and activating the gag reflex. In addition, tongue scrapers are unable to remove debris from the depressions and papillae in the tongue.

It has recently been found that stimulating the tongue, as by scraping or brushing, can accelerate the speech recovery process after a stroke. Attempting to brush or scrape with a conventional toothbrush or known tongue brushing methods is a long, tedious process which may be uncomfortable.

Accordingly, there is a long felt need for a tongue brush which is capable of effectively cleaning the entire tongue without activating the gag reflex, and it would be very desirable to have method of thoroughly cleaning or brushing a tongue with little discomfort.

SUMMARY OF THE INVENTION

The present invention seeks to provide a device for cleaning the surface of the root of the human tongue, and a method of use thereof, thereby to provide a reduction in pathological microorganisms in the oral cavity, in general, and so as to provide a solution to the problem of halitosis, in particular. The device and method are also particularly suited to stimulation of the tongue for patients after stroke.

The device and method of the invention are convenient and efficient, such that it is anticipated that the invention will lead to a change in oral cleaning habits to those which include tongue root cleaning as per the present invention.

There is thus provided, in accordance with a preferred embodiment of the present invention, a device for mechanically cleaning the surface of the root of the human tongue including a cleaning head configured for entry between the soft palate and the surface of the human tongue root, and having abrasive means for mechanically removing pathological microorganisms from the surface of the tongue root, and a handle connected to the cleaning head for the manipulation thereof, wherein the device has an overall maximum height at the cleaning head of no more than approximately 15 mm, and wherein the cleaning head is concavely bent.

Additionally in accordance with the present invention, the device is characterized by one or more of the following:

the ratio of the width of said cleaning head to the overall height of said device at the cleaning head is greater than 1.0; and the ratio of the width of said cleaning head to the length thereof is greater than 0.5, and preferably no less than 1.0.

Typically, the width of the cleaning head is in the range 2.0–5.0 cm, and, preferably, 3.0 to 4.0 cm.

Further in accordance with the present invention, the cleaning head also includes a base portion, and the abrasive means is attached thereto and includes a plurality of brush filaments extending transversely from the base, a sponge, or a plurality of bristle members extending transversely from the base.

Preferably, the handle includes a generally flat, guide portion located such that when the abrasive means is located in engagement with the tongue root, the guide portion is positioned between the lips of the user when they are in a rest position.

BRIEF DESCRIPTION OF THE DRAWINGS

The present invention will be further understood and appreciated from the following detailed description, taken in conjunction with the drawings, in which.

DETAILED DESCRIPTION OF THE INVENTION

Reference is now made to FIGS. 1*a*–2C, in which there is seen a device, referenced generally 10, constructed in accordance with different embodiments of the invention, for cleaning the tongue root and thereby, inter alia, to provide a solution to the problem of halitosis, in accordance with the present invention.

Figure 3:
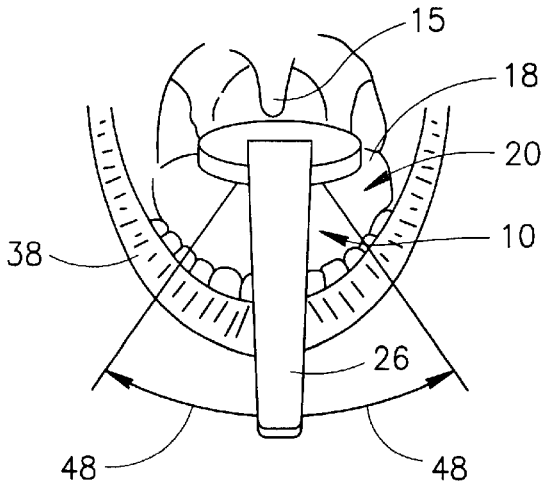
FIG. 3 is a schematic front view illustrating use of the device of the invention.
Figure 4:
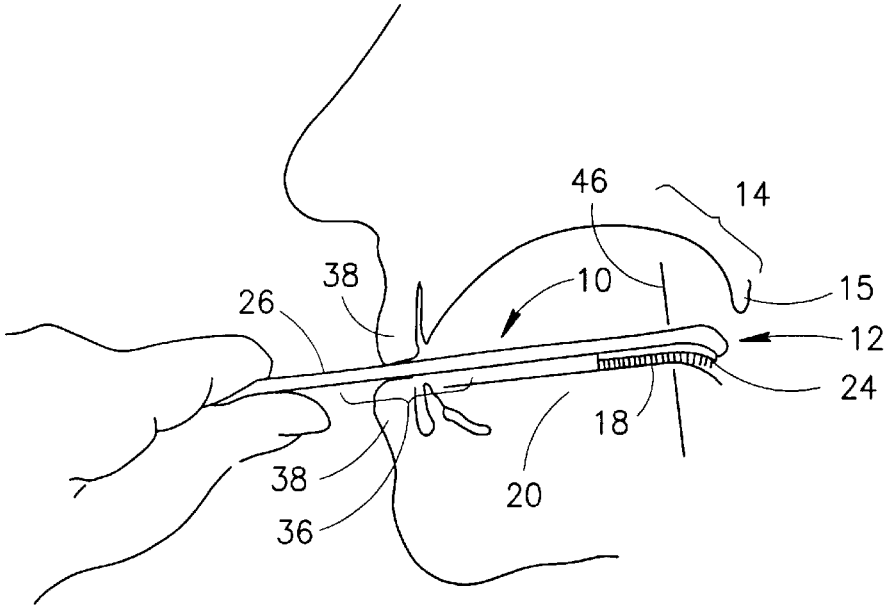
FIG. 4 is a schematic side sectional view illustrating use of the device of the invention.

Referring now also to FIGS. 3 and 4, it is seen that device 10 has a cleaning head 12 that is configured for entry between the soft palate region 14 (FIG. 4) of the human mouth, terminating in the uvula 15, and the upper surface of the root 18 of the human tongue 20. Cleaning head 12 has a base portion 22 and an abrasive portion 24 attached thereto.

In accordance with the present invention, abrasive portion 24 is formed so as to enable scrubbing of the tongue root surface 16, thereby to mechanically remove therefrom pathological microorganisms. Device 10 also has a handle 26 that is attached to cleaning head 12 for manipulation thereof. The base portion 22 of cleaning head 12 and handle 26 are preferably formed of plastic, and may be attached by any suitable means, such as by a suitable adhesive, for example. According to one embodiment of the invention, cleaning head 12 and handle 26 may be integrally formed as by injection molding.

It will be appreciated that, in accordance with an alternative embodiment of the invention, handle 26 and base portion 22 of cleaning head 12 are formed of a non-plastic material, such as wood or metal, for example.

Figure 1A:
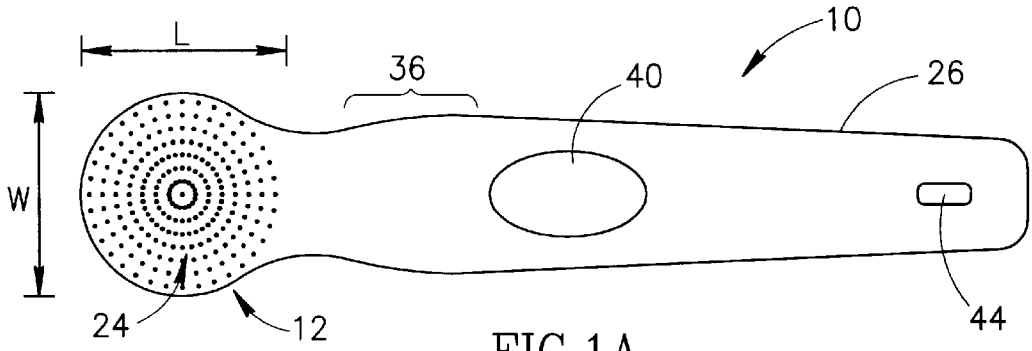
FIG. 1A is a bottom view of a device for cleaning the surface of the root of the human tongue constructed in accordance with an embodiment of the invention.
Figure 1B:
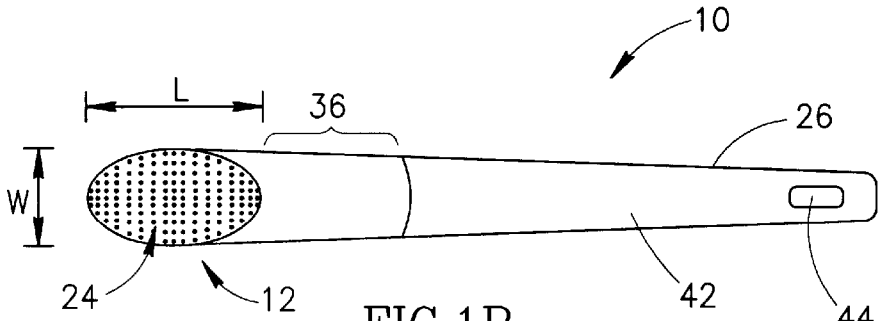
FIG. 1B is a bottom view of a device similar to that shown in FIG. 1A, but having a cleaning head configuration in accordance with an alternative embodiment of the invention.
Figure 1C:
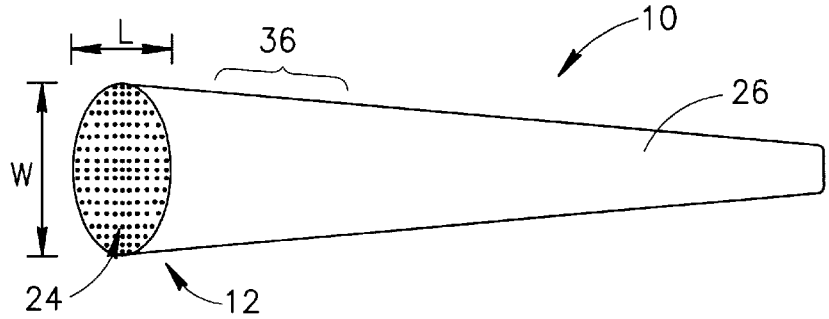
FIG. 1C is a bottom view of a device similar to that shown in FIGS. 1*a* and 1B, but having a cleaning head configuration in accordance with a further embodiment of the invention.

In order to avoid discomfort to a user, cleaning head 12 preferably has a generally flat, wide configuration, preferably having a width not substantially less than that of the tongue of an average adult human, and so as to have a generally round or oval configuration, as seen in FIGS. 1A–1C. These characteristics enable the tongue root to be cleaned with minimal relative movement between the device and the tongue root, and thus reduce the likelihood of bruising or otherwise damaging soft palate tissue, in the event that it is contacted by the cleaning head 12. The configuration of the cleaning head 12 further reduces the possibility of gagging or vomiting, which could arise by insertion of a thick member, such as a toothbrush head—which is clearly not suitable for the purpose of the invention—into the rear of the oral cavity between the soft palate 14 and the tongue root surface 16.

Figure 8A:
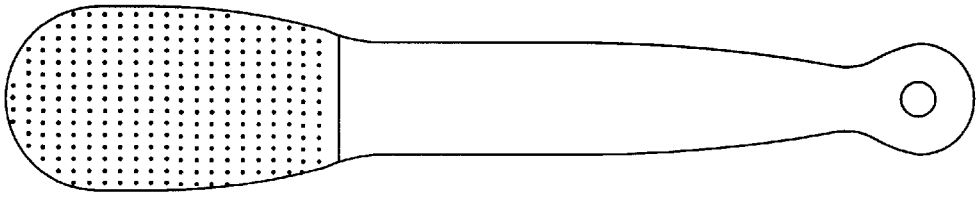
FIG. 8A is a bottom view of a device for cleaning the surface of the root of the human tongue constructed in accordance with another embodiment of the invention.
Figure 8B:
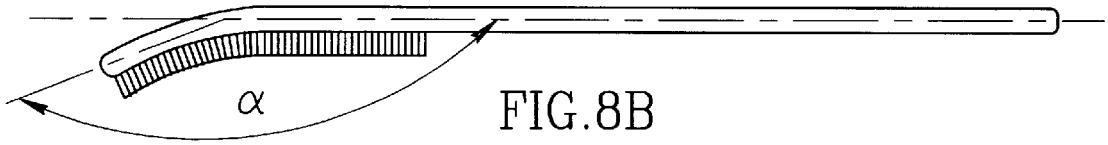
FIG. 8*b* is a side view of the device of FIG. 8*a*.

As can be seen, the cleaning head 12 is bent concavely near the bristles. Bending the cleaning head enlarges the distance of the cleaning head from the uvula, thereby reducing the possibility of activating the gag-reflex during tongue cleaning. In addition, this shape provides a more convenient approach to the posterior part of the tongue, the part which it is most important to clean. While a wide range of angles can be utilized, the preferred internal angle $\alpha$ for the curvature of the head is between about 115° and 165°, most preferably between 135° and 150°, as shown in FIG. 8*b*.

Preferably, the overall maximum height 'H' (FIGS. 2A–2C) of the device 10 at the cleaning head 12, is no more than approximately 15 mm. This enables insertion of cleaning head 12 into the rear of the oral cavity between the soft palate 14 and the tongue root surface 16, of an average human adult, substantially without causing discomfort. It will be appreciated, however, that the smaller the height of the device at the cleaning head, the greater is the utility of the device. Accordingly, H is preferably less than 12 mm and may even be less than 8 mm.

As seen in FIGS. 1A–2C, the ratio of the width 'W' (FIGS. 1A–1C) of cleaning head 12 to the height H (FIGS. 2A–2C) of the device at the cleaning head, is preferably greater than 1.0, and may be as much as 10. It will be appreciated that 15 mm is a maximum height, and that, as described above, height H may, in fact, be substantially less than 15 mm, particularly when the device is intended for use by children, for example.

Figure 1D:
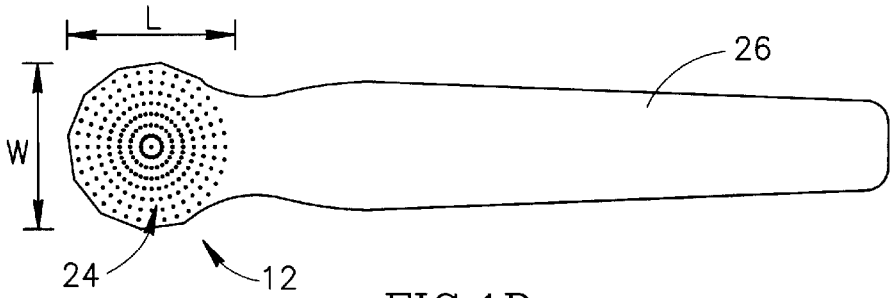
FIG. 1D is a bottom view of a device similar to any of those of FIGS. 1*a*–1C, but having a polygonal head.

As described above and as seen in FIGS. 1A–1D, cleaning head 12 is preferably wide and formed without comers or protruding portions that might contact soft tissue of peripheral portions of the oral cavity. Accordingly, the ratio of the width W (FIGS. 2A–2C) of cleaning head 12 to the length 'L' (FIGS. 1A–2C) thereof is preferably greater than 0.5. In the example of FIGS. 1A, cleaning head 12 is circular and thus the ratio W:L is 1.0; in the example of FIG. 1B, cleaning head 12 is oval, having a ratio W:L of approximately 0.6; and in the example of FIG. 1C, cleaning head 12 is oval, having a ratio W:L of approximately 1.75. In the example of FIG. 1D, cleaning head 12 is polygonal, and has a ratio W:L of approximately 1.0.

Typically, the width of the cleaning head 12 is in the range 2.0–5.0 cm, and is preferably in the 3.0–4.0 range.

Figure 2A:
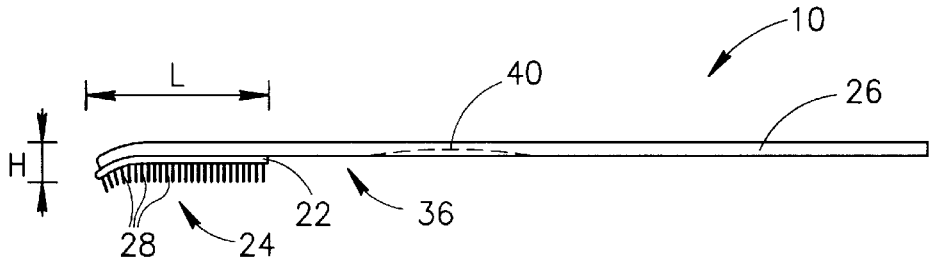
FIG. 2A is a schematic side view of any of the devices seen in FIGS. 1A–1C.

Referring now particularly to FIG. 2A, abrasive portion 24 may be a plurality of bristle members 28 which are either inserted into base portion 22, attached thereto by a suitable adhesive, or integrally formed therewith as by injection molding.

Figure 2B:
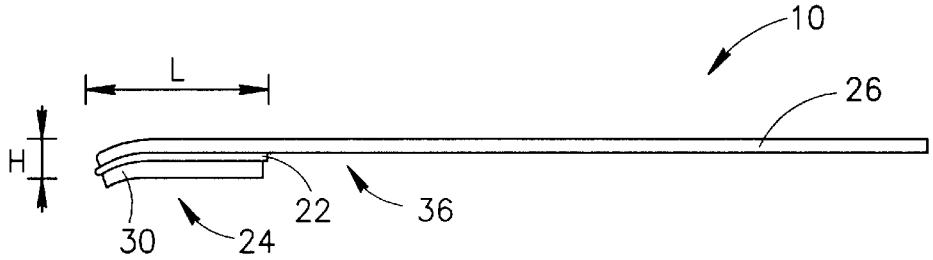
FIGS. 2B and 2C are side views of a cleaning head portion of any of the devices seen in FIGS. 1A–1C, illustrating two further embodiments thereof.
Figure 2C:
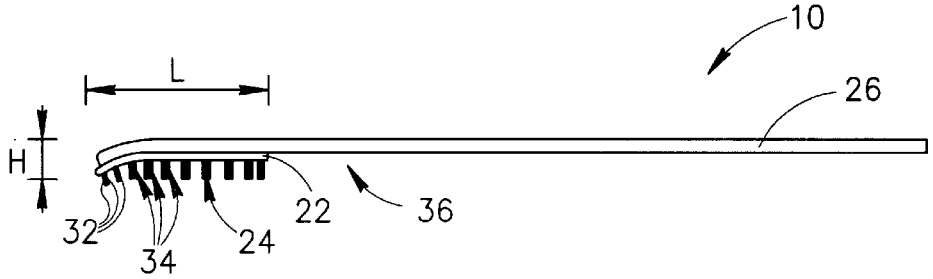

Alternatively, as seen in FIG. 2B, abrasive portion 24 may comprise a portion of sponge 30. According to yet a further embodiment of the invention, as seen in FIG. 2C, the abrasive portion 24 may be formed of a plurality of brush filaments 32 extending transversely from the base portion 22. Typically, brush filaments 32 are arranged in groups of tufts 34 and inserted into the base portion 22 as with toothbrushes, although any alternative arrangement of the brush filaments 32 may also be provided.

Referring now particularly to FIGS. 1A–2A, it is seen that handle 26 has a generally flat, guide portion 36. Guide portion 36 is located along the handle such that when the abrasive portion 24 is located in engagement with the tongue root 18, the guide portion 36 is positioned between the lips 38 of the user, as seen in FIG. 4. This is a particular feature of the invention, as it enables the lips 38 to act as tracks or guides for the device 10 when in use, as described below in conjunction with FIGS. 3 and 4. Typically, the guide portion 36 has a width of greater than 1.5 cm, and preferably between 2.0 and 4.0 cm.

As additional features, handle 26 may also have a molded grip portion 40 (FIGS. 1A and 2A), typically formed as a recess, it may have a thickened portion 42 (FIG. 1B) for gripping, or it may have a handle of generally uniform thickness. An opening 44 may also be provided for enabling the device to be hung up when not in use, thereby enabling air drying thereof.

Referring now to FIGS. 3 and 4, the present invention provides a method of mechanically cleaning the surface 16 of the root 18 of the human tongue 20 so as to remove pathological microorganisms therefrom. In addition to reducing halitosis, which is particularly desirable before social and public appearances, tongue brushing helps reduce the microorganisms in the mouth of those wearing full dentures or having tooth implants. In use, the cleaning head 12 of device 10 is inserted into the mouth between the palate 13, and particularly the soft palate 14, and the upper surface of the tongue root 18. Subsequently, lips 38 are loosely closed in a rest position about guide portion 36 of the handle 26, and the handle 26 is moved in a reciprocal-type pivoting motion (FIG. 3) about a pivot axis 46, typically in an arc such as that indicated by arrows 48 in FIG. 3. When the lips are in a rest position, the tongue and throat muscles are relaxed, facilitating entry of the tongue brush between the palate and the tongue root, and diminishing the gag reflex. This causes a scrubbing of the tongue root, thereby to mechanically remove therefrom pathological microorganisms. Small rotational motions may also, or alternatively, be used. It is a particular feature of the invention that the wide handle permits easy gripping and rotation by the hand, while the wide head brushes a relatively large surface of the tongue during each stroke.

Preferably, the method also includes use of a mouthwash to the oral cavity while cleaning, thereby chemically aiding the mechanical cleaning process. The mouthwash may be supplied either directly to the oral cavity or via the cleaning head 12. The mouthwash can be selected so as to improve the removal of fungus, such as Candida and Monilia, from the tongue after massive doses of antibiotics, or to reduce laryngitis and other throat infections. A further advantage of using a mouthwash is that, even after device 10 has been rinsed subsequent to use, a residue of the mouthwash remains on the device, thereby aiding disinfection thereof.

Since the lips 38 act as a track or guide for the device 10 and particularly for the guide portion 36, the handle 26 and the cleaning head 12 are positioned generally parallel to the tongue and in contact therewith. Furthermore, the relative motion obtained is parallel to the interface between the abrasive portion 24 and the tongue root surface 16.

In accordance with an alternative method of the invention, after insertion of the device 10 into the mouth and gripping of the handle 12 by lips 38, a desired scrubbing motion may be achieved simply by moving the tongue relative to the abrasive portion 24.

Figure 5A:
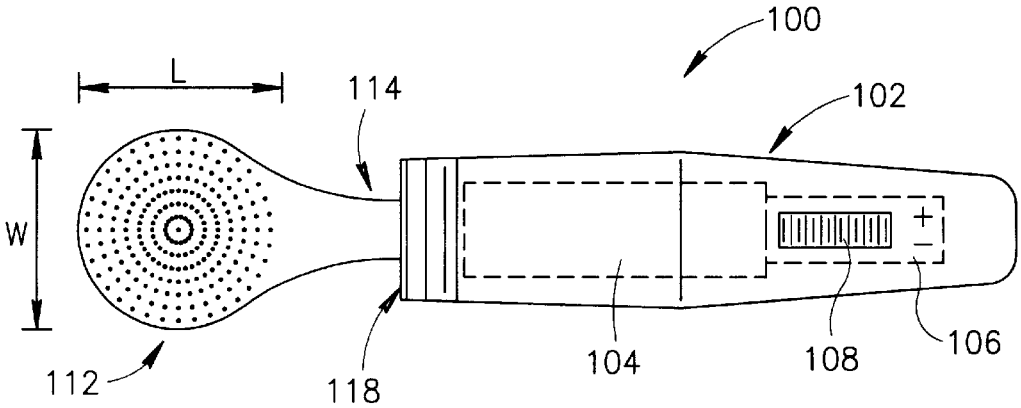
FIGS. 5A and 5B are bottom and side views, respectively, of an electrically powered device, constructed in accordance with a further embodiment of the invention.
Figure 5B:
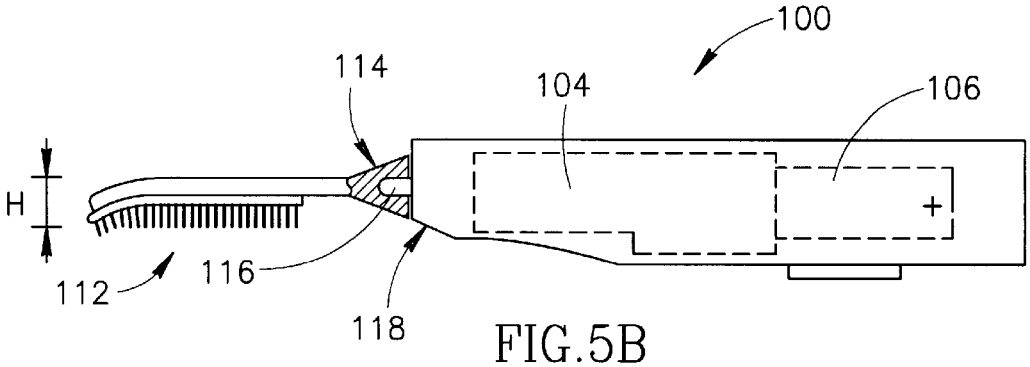

Referring now to FIGS. 5*a* and 5B, there is provided, in accordance with a further embodiment of the invention, an electrically powered hand-held device, referenced generally 100, for cleaning the tongue root, thereby to remove therefrom pathological organisms. Device 100 has a handle 102 which houses therein a motive mechanism, shown schematically as hidden detail at 104 in FIG. 5A, for imparting a predetermined type of motion to cleaning head 112. Typically, this is a rotary, an oscillatory or a vibratory type motion. A power source and on-off switch are shown respectively, at 106 and 108. Mechanism 104 may include any suitable electric motor and transmission such as used in any commercially available electric toothbrush, and is thus not described herein in detail.

The construction and use of cleaning head 112 are similar to those described above for cleaning head 12 (FIGS. 1A–4). Accordingly, cleaning head 112 is not described specifically herein, except in as much as it differs from cleaning head 12 and as may be necessary to understand the present embodiment.

Preferably, cleaning head 112 has rear portion 114 which is configured for removable bayonet mounting onto an output element 115 (FIG. 5B) of motive mechanism 104, and which protrudes from a front portion 118 of handle 102.

In accordance with an alternative embodiment, cleaning head may be non-removably attached to motive mechanism 104. The motion imparted by oscillating mechanism 104 to cleaning head 112 is preferably similar to the manually transmitted motion described above in conjunction with FIGS. 1A–4, and is thus not described again herein in detail.

Figure 6A:
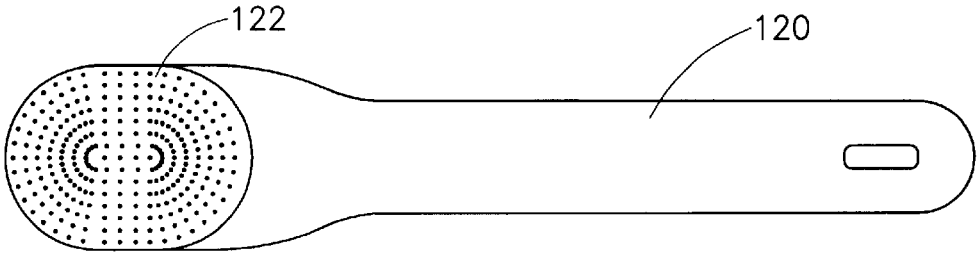
FIGS. 6*a* and 6*b* are plan and side views, respectively, of a device constructed in accordance with a further embodiment of the invention.
Figure 6B:
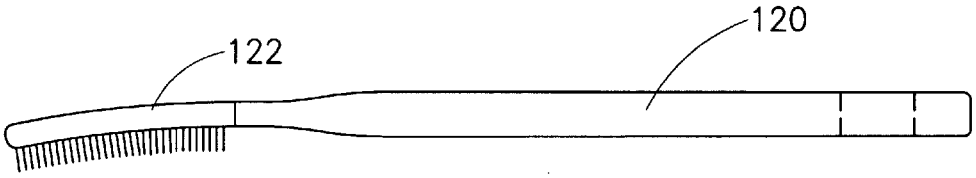

FIGS. 6*a* and 6*b* are plan and side views, respectively, of a device 120 for cleaning the tongue root, constructed in accordance with another embodiment of the present invention. Device 120 is substantially similar to the devices described in detail hereinabove, except that the brush head 122 is elongated in shape.

Figure 7:
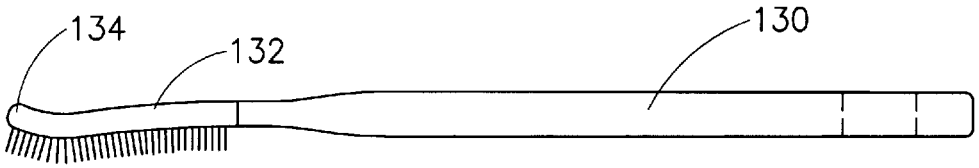
FIG. 7 is a side view of a device constructed in accordance with an alternative embodiment of the invention.

FIG. 7 illustrates another tongue brushing device 130 according to the present invention. This device also includes a bent brush head 132, but here the tip 134 of brush head 132 is slightly concave.

The head of the brush may be formed of a single part, the overall thickness (of the head and the bristles) being in the range of about 5–10 mm.

The brush head can be of any oval or circular shape. The bristles can be mounted on the brush head in varying density, and can be continuous or in discontinuous sections.

According to one preferred embodiment, the brush head is separate from and mounted on the handle, as by screws. This provides quick and easy replacement of the head after wear, without requiring the user to throw away the entire brush.

It will be appreciated by those skilled in the art that the invention is not limited to what has been described hereinabove by way of example. Rather the scope of the invention is limited solely by the claims which follow.

What is claimed is:

1. A device for mechanically cleaning the surface of the root of the human tongue comprising:

a substantially rigid cleaning head configured for entry between the soft palate and the surface of the human tongue root, and having abrasive means for mechanically removing pathological microorganisms from the surface of the tongue root; and a handle connected to said cleaning head for manipulation thereof and comprising a generally flat, guide portion having a width of at least 1.5 cm, said guide portion being located such that when said abrasive means is located in engagement with the tongue root, said guide portion is positioned between the lips of the user;

wherein the width of said cleaning head is in the range 2.0 to 5.0 cm;

wherein said device has an overall maximum height at said cleaning head of no more than approximately 15 mm; and wherein said cleaning head has a substantially flat portion and includes a tip, which tip is concavely bent about an axis perpendicular to and coplanar with said guide portion.

2. A device according to claim 1, and wherein said device has an overall maximum height at said cleaning head of no more than approximately 12 mm.

3. A device according to claim 2, and wherein said device has an overall maximum height at said cleaning head of no more than approximately 8 mm.

4. A device according to claim 1, and wherein the ratio of the width of said cleaning head to the overall height of said device at said cleaning head is greater than 1.0.

5. A device according to claim 1, and wherein the ratio of the width of said cleaning head to the length thereof is greater than 0.5.

6. A device according to claim 5, and wherein the ratio of the width of said cleaning head to the length thereof is no less than 1.0.

7. A device according to claim 1, and wherein said cleaning head has a plane shape selected from the group consisting of: circular, oval, and polygonal.

8. A device according to claim 1, wherein the width of said cleaning head is in the range 3.0 to 4.0 cm.

9. A device according to claim 1, and wherein said cleaning head also comprises a base portion, and said abrasive means is attached thereto and comprises one of the group consisting of:

a plurality of brush filaments extending transversely from said base;

a sponge; and a plurality of bristle members extending transversely from said base.

10. A device according to claim 1, and wherein said abrasive means is molded integrally with said base.

11. A device according to claim 1, and wherein said guide portion has a width in the range of 2.0 to 4.0 cm.

12. A device according to claim 1, and wherein said handle houses electrically powered motive means for selectably imparting motion to said cleaning head.

13. A device according to claim 12, wherein said motive means has an output element extending from a forward end of said handle, and said cleaning head is formed with a rear portion configured for removable mounting onto said output element.

* * * * *